United States Patent [19]

Wolfe

[11] 4,050,106

[45] Sept. 27, 1977

[54] FOLDING BED ASSEMBLY

[76] Inventor: Lester Wolfe, 870 United Nations Plaza, New York, N.Y. 10017

[21] Appl. No.: 681,349

[22] Filed: Apr. 28, 1976

[51] Int. Cl.[2] ..... A47C 13/18

[52] U.S. Cl. ..... 5/10 R; 5/164 D; 5/137

[58] Field of Search ..... 5/10 R, 133, 136, 164 R, 5/164 B, 164 C, 164 E, 137, 165, 159 R, 159 B, 159 V, 160, 167, 148

[56] References Cited

U.S. PATENT DOCUMENTS

| | | | |
|---|---|---|---|
| 442,725 | 12/1890 | Hayes et al. | 5/137 |
| 482,266 | 9/1892 | Nevins | 5/164 R |
| 1,001,214 | 8/1911 | Mulvaney | 5/160 |
| 1,542,766 | 6/1925 | Hall | 5/133 |
| Re. 10,225 | 10/1882 | Burr | 5/160 |

*Primary Examiner*—Casmir A. Nunberg
*Attorney, Agent, or Firm*—Parmelee, Johnson & Bollinger

[57] ABSTRACT

A spring-balanced wall-type bed is pivotable between a vertical position into a wall recess and a horizontal position out of the wall recess in conjunction with a wall panel attached to the bottom of the bed so as to function as a closure for the wall recess when the bed is swung into the recess in its vertical position. In its horizontal position, the bed has unfolded legs having rollers thereon which bear against the wall panel which rests upon the floor. The bed and panel are maintained in contact by the springs so as to be pivotable together.

6 Claims, 5 Drawing Figures

FOLDING BED ASSEMBLY

The present invention relates to a wall bed which is pivotable between a vertical position into a wall recess and a horizontal position out of the wall recess and, more particularly, to a closure member for the wall recess which closure is pivotable together with the bed.

In order to conserve space in dwellings where only a limited space may be available, it has been proposed to construct various forms of beds which may be retracted against or folded into a wall of the dwelling while not in use. Various constructions have been proposed in order to facilitate the pivoting of such a bed into and out of its horizontal position for use. One form of such a retractable bed is pivoted into and out of a wall closure, and various forms of closure members are provided to enclose the recess when the bed has been folded therein. Such closure members have even comprised cabinets and other pieces of furniture which may be moved into position so as to conceal the location of the bed. A disadvantage of most of such beds is that in order to use the bed, the closure member must first be opened or removed and the bed then folded or pivoted outwardly. Very little attempt has been made to conceal the location of the bed and where structure has been proposed to conceal such locations of the retracted bed, the structure has been relatively complicated.

It is an object of the present invention to provide a novel and improved wall bed.

It is another object to provide a wall bed which conserves wall space, eliminates any need for doors and door space and conceals the bed when the bed is not in use.

It is a further object to provide a wall bed and closure member which are movable as a unit so as to facilitate use of the bed.

According to one aspect of the present invention, a wall bed pivotable between a vertical position into a wall recess and a substantially horizontal position out of the wall recess comprises a bed frame which has one end pivotally connected to a mounting frame fixed to the floor of the recess. The bed frame is pivotable between vertical and horizontal positions, and a first tension spring connects the one end of the bed frame to the floor of the wall recess. The panel has one end pivotally mounted to the floor and is pivotable to a vertical position to close the wall recess and conceal the bed therein. The panel is also pivotable to a horizontal position upon the floor. The bed is supported upon the panel by folding leg means when the bed frame and the panel are both pivoted to their horizontal positions. A second tension spring connects the other end of the bed frame to the panel such that the bed frame and panel are pivotable together between horizontal and vertical positions.

The above and other objects and novel features of the present invention will become apparent from the following specification and accompanying drawings which are merely exemplary.

In the drawings.

Proceeding next to the drawings wherein like reference symbols indicate the same parts throughout the various views, a specific embodiment of the present invention will be described in detail.

Figures 1, 2, 3, 4, 5:
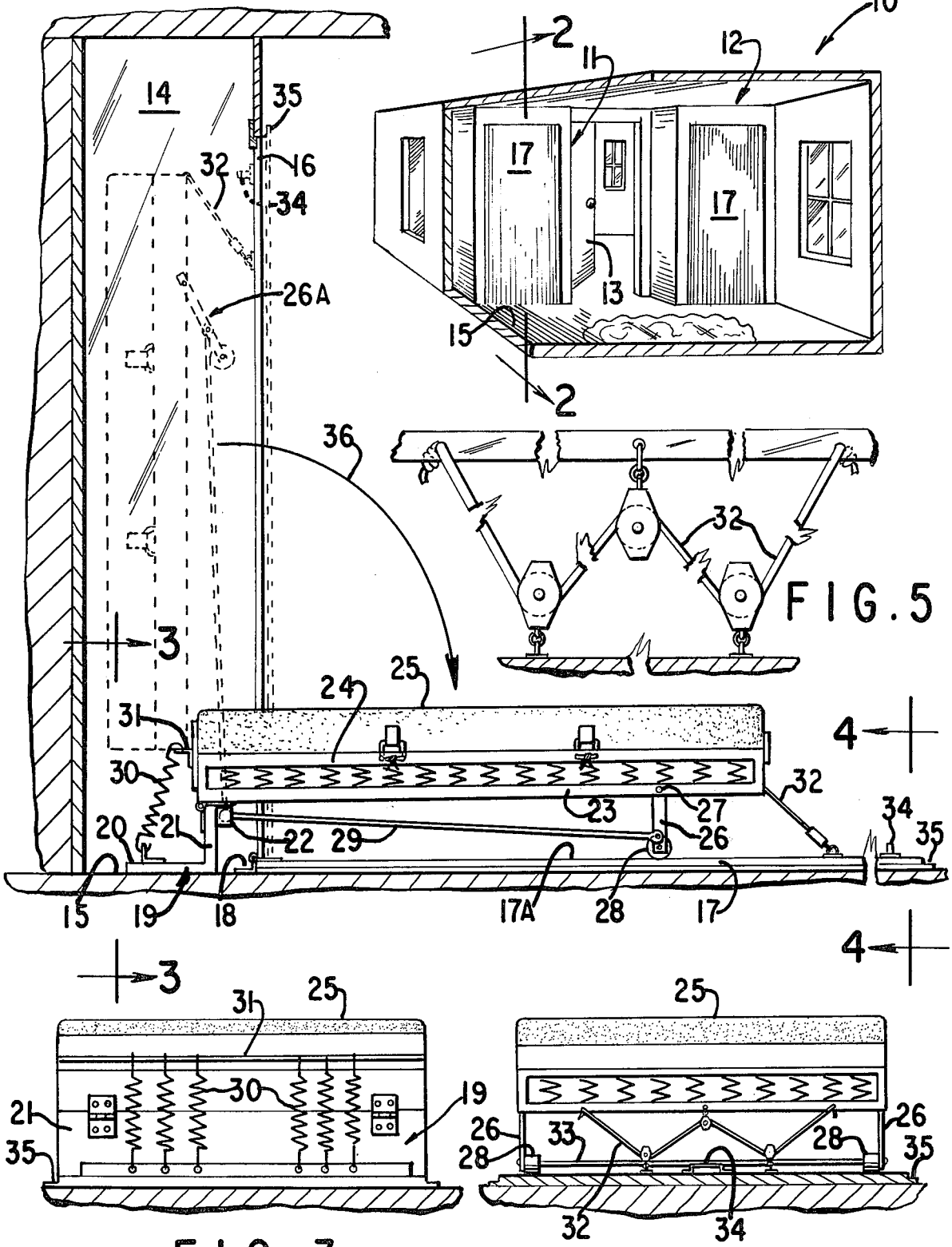
FIG. 1 is a perspective view of a room in which two wall beds according to the present invention are installed and are pivoted into their vertical positions into their respective wall recesses.
FIG. 2 is a vertical sectional view through one of the recesses taken along the line 2—2 of FIG. 1 and showing the bed in the horizontal position.
FIG. 3 is an end elevational view of the bed viewed in the direction of the line 3—3 of FIG. 2.
FIG. 4 is an end elevational view of the bed viewed in the direction of the line 4—4 of FIG. 2.
FIG. 5 is an end elevational view substantially similar to the view of FIG. 4 but in enlarged scale and showing the tension spring structure.

In FIG. 1, there is indicated generally at 10 a room of a dwelling in which wall beds 11 and 12 according to the present invention are installed. The recesses in which the beds 11 and 12 are concealed comprise structural units of the room and between these recesses there may be provided a door 13 leading to another room.

The bed 11 as shown in greater detail in FIG. 2 comprises a wall recess 14 mounted upon a floor 15 of the dwelling. The recess is provided with a front opening 16 which is closed by a panel 17 whose lower end is pivotally mounted at 18 to the floor 15. On the floor 15 within the recess 14, there is attached a mounting frame 19 which is substantially L-shaped with one of the legs 20 being attached to the floor by screws or bolts. The other leg 21 of the mounting frame 19 is provided with a ball and socket connection 22 to which one end of a bed frame 23 is pivotally connected. The bed frame 23 may comprise a ball which is pivotally received within the socket mounted on the frame 19. The bed frame is provided with a conventional bed spring 24 and a mattress 25.

A pair of legs 26 are pivotally mounted at 27 to the underside of the bed frame 23 and the lower ends of the legs are provided with rollers 28 which roll upon the inner surface 17A of the panel 17. A link 29 connects each leg 26 to the mounting frame 19 so that upon pivoting of the bed upwardly into its vertical position as shown by the dashed lines in FIG. 2, the legs 26 will be folded away from the panel and into the position as shown at 26A.

Multiple counter-balancing tension springs 30 are connected between leg 20 of the mounting frame 19 and the inner end of the bed frame 23 which may be provided with a suitable angle connection 31. The spring 30 may also be connected directly to the floor 15 within the recess 14.

The other end of the bed frame 23 is connected by means of a shock cord and pulley arrangement 32 to the inner surface 17A of the panel 17. Tension springs may also be used for this purpose.

The rollers 28 may be mounted upon a shaft 33 which extends between the legs 26. The inner surface 17A of the panel 17 is provided with a handle 34 adjacent the outer or upper end of the panel. The pulleys of the shock cord arrangement 32 may be adjustably mounted so as to vary the tension on the shock cord. The shock cord may comprise a resilient cable or rope as known in the art.

The outer edge of the panel 17 is provided with a molding 35 which can function as a handle to pivot the bed and panel into the position as shown in FIG. 2. No other hardware need be provided on the panel for operating of the bed, and the only piece of hardward which is necessary is the handle 34 which is provided on the inner surface of the panel and, therefore, is not visible when the bed is in its folded position as shown in FIG. 1.

In order to pull the bed down from its vertical position, it is only necessary to position the fingers behind the molding 35 and the panel 17 and bed frame 23 will be pivoted downwardly together in the direction of the arrow 36 into the horizontal position as shown in FIG. 2. As the panel and bed pivot downwardly, the legs 26 will be unfolded under the action of the link 29, and as the legs unfold, the rollers 28 will roll against the panel. The rollers will be maintained in contact with the panel under the tension exerted by the shock cord arrangement 32. The action of the rollers 28 against the panel also forces the panel down until it is in its horizontal position resting upon the floor.

When it is desired to fold the bed into the wall, it is merely necessary to grip the handle 34 and pull upwardly. Relatively little force would be required because of the counter-balancing springs 30 which will be acting in tension upon the inner end of the bed frame. The bed frame and panel will then pivot upwardly together into the position as shown by the dashed lines in FIG. 2.

It will be understood that various details of construction and arrangement of parts may be changed without departing from the spirit of the invention except as defined in the appended claims.

What is claimed is:

1. A wall bed pivotable between a vertical position into a wall recess and a substantially horizontal position out of the wall recess, comprising a mounting frame fixed to a floor within a wall recess, a bed frame having one end thereof pivotally connected to said mounting frame and pivotable between vertical and horizontal positions, first tension spring means interconnecting said one end of said bed frame and the floor of the wall recess, a panel having one end pivotally mounted to the floor and said panel being pivotable to a vertical position to close the wall recess and to conceal the bed therein and to a horizontal position upon the floor, means supporting said bed frame upon said panel when said bed frame and panel are both pivoted to their horizontal positions, and second tension spring means connecting the other end of said bed frame to said panel near the other end of said panel for pulling said other end of said bed frame and said panel toward each other such that said bed frame and panel are pivotable together simultaneously between vertical and horizontal positions, and said second tension spring means acting upon said other end of said bed frame to facilitate the pivoting of said bed frame from its vertical to its horizontal position upon pulling down on said other end of the panel.

2. A wall bed as claimed in claim 1 wherein said first spring means has sufficient force to counter-balance said bed frame and said panel, thereby retaining said bed frame and said panel in their vertical positions and facilitating the pivoting thereof from said horizontal to said vertical positions.

3. A wall bed as claimed in claim 1 wherein said bed frame support means comprises leg means having roller means thereon engageable with said panel, said second spring means urging said roller means into contact with said panel, and said roller means thereby exerting a force on said panel toward the horizontal pivotal direction to facilitate said pivoting of said bed and panel together from said vertical to said horizontal positions.

4. A wall bed as claimed in claim 3 wherein said leg means comprises a pair of legs pivotally mounted on said bed frame, linkage means for connecting said pivotable legs and said mounting frame to fold and unfold said legs upon pivoting of said bed frame and panel between vertical and horizontal positions.

5. A wall bed as claimed in claim 1 wherein said panel comprises a wall panel closing said wall recess when the bed is in its vertical position.

6. A wall bed as claimed in claim 1 and means for adjusting the tension of said second tension spring means.

* * * * *